United States Patent [19]

Dunham et al.

[11] Patent Number: 4,569,292

[45] Date of Patent: Feb. 11, 1986

[54] RAILWAY CAR FOR TRANSPORTING LIQUIDS

[75] Inventors: Myrl G. Dunham, Lorton, Va.; David G. Naves, Ft. Washington, Md.

[73] Assignee: Fruit Growers Express Company, Alexandria, Va.

[21] Appl. No.: 572,081

[22] Filed: Jan. 19, 1984

[51] Int. Cl.[4] ..... B61D 5/00

[52] U.S. Cl. ..... 105/358; 410/143

[58] Field of Search ..... 105/358, 360, 359, 361, 105/362, 355; 410/143, 144, 152, 129; 62/239, 242

[56] References Cited

U.S. PATENT DOCUMENTS

| | | | |
|---|---|---|---|
| 1,089,535 | 3/1914 | Coyle | 105/362 |
| 1,248,763 | 12/1917 | Waugh | 105/361 |
| 1,472,078 | 10/1923 | Lucius | 105/359 |
| 1,518,471 | 12/1924 | Weaver . | |
| 1,607,327 | 11/1926 | Weaver . | |
| 1,608,224 | 11/1926 | Mauran . | |
| 1,691,873 | 11/1928 | Weaver . | |
| 1,754,450 | 4/1930 | Willoughby . | |
| 1,817,581 | 8/1931 | Pierce | 105/362 |
| 1,876,189 | 9/1932 | Willoughby . | |
| 2,102,124 | 12/1937 | Lithgow | 220/1 |
| 2,229,081 | 1/1941 | Hansen et al. | 62/1 |
| 2,229,888 | 1/1941 | Fraser | 105/410 |
| 2,290,038 | 7/1942 | Folmsbee | 62/1 |
| 2,546,232 | 3/1951 | Owens | 105/417 |
| 2,635,559 | 4/1953 | Nystrom et al. | 105/416 |
| 2,640,443 | 6/1953 | Schieler et al. | 105/404 |
| 2,706,454 | 4/1955 | Sleeman et al. | 105/410 |
| 2,788,750 | 4/1957 | Priest | 105/406 |
| 2,881,600 | 4/1959 | Elfving | 62/239 |
| 2,894,462 | 7/1959 | Newcomer et al. | 410/143 X |
| 3,067,699 | 12/1962 | Fredriks | 105/454 X |
| 3,295,465 | 1/1967 | Borger | 105/414 |
| 3,777,671 | 12/1973 | Miller et al. | 105/420 |
| 3,866,546 | 2/1975 | Malo | 105/410 |
| 4,194,451 | 3/1980 | Dehner | 105/416 |

OTHER PUBLICATIONS

Ellsworth, K. G., "The Car and Locomotive Cyclopedia of American Practices", 1980, pp. 205–235.

*Primary Examiner*—Harry Tanner

*Attorney, Agent, or Firm*—Pollock, Vande Sande & Priddy

[57] ABSTRACT

A method is disclosed for enclosing a large cylindrical container within an existing refrigerated railway car by affixing structural framework to the container for supporting vertical forces, removing one end of the railway car, sliding the container, which is supported in a horizontal position within the railway car, securing the container in place by structural members extending from the supporting framework of the container through the floor to the center sill, and replacing the end of the railway car. Structural members are provided to transmit longitudinal forces to one end wall and to a bulkhead position near the other end wall.

13 Claims, 7 Drawing Figures

RAILWAY CAR FOR TRANSPORTING LIQUIDS

This invention relates to railway cars, and more specifically, to railway cars for transporting perishable liquids which must be kept refrigerated during transportation.

For reasons of economics, it has become desirable to provide a refrigerated railway car capable of containing perishable liquids in extremely large volumes, e.g., about 600 barrels, or about 18,600 gallons. The need for such a railway car has become particularly apparent for transporting liquids, the perishable nature of which requires that their temperature be kept within several degrees of 32° F. Refrigerated railway cars in which the car interior can be maintained at that temperature are presently available. However, the use of such cars to transport liquid volumes as great as 600 barrels per railway car has not heretofor been considered to be practical. While the economics of handling and transporting liquids, and the large volume required per car, dictate that a single container be used per railway car, there are problems involved in combining a liquid container of the desired dimensions and resulting weight with an existing refrigerated car. These problems include: the difficulty of placing the container within the railway car; properly distributing the weight of a loaded container; providing access for personnel to repair and maintain a refrigeration system within the confines of the car; and, providing means to distribute forces encountered during shipment to those portions of the railway car which can withstand them.

U.S. Pat. No. 2,229,081 to O. A. Hanson et al shows a single container within a railway car; however, there is no indication that the container was placed in an existing railway car, and the nature of the structure suggests that the car and the container did not exist as separate entities.

U.S. Pat. No. 1,607,327 to Robert R. Weaver discloses a refrigerator car containing two liquid containers which are adapted to be placed within and removed from the refrigerator car through the top of the car including steps of removing and replacing the roof of the refrigerator car. Special means were incorporated in the roof design in order to facilitate the removal and replacement of the roof.

U.S. Pat. No. 1,691,873 to Robert R. Weaver discloses details for securing two cylindrical liquid containers within a railway car. The containers are secured horizontally in place within cradling structures by bands which partially encircle the upper portions of the containers.

Insulated tank cars are available commercially. See, for example, "The Car and Locomotive Cyclopedia", Simmons-Boardman, 1980, pages 205–234. Although some of these tank cars are large enough to contain a volume of about 600 barrels or more they are not provided with refrigeration means necessary to retain the contents at a temperature within about 2° F. of 32° F.

SUMMARY OF THE INVENTION

It is one object of this invention to provide a method of installing, in a pre-existing refrigerator railway car, a single container having a large capacity for liquids.

It is another object to provide a method of maximizing the amount of liquid which can be carried within a pre-existing refrigerator railway car.

It is still another object to provide the combination of a single large cylindrical container and a refrigerator railway car, including means for distributing longitudinal forces which are encountered during movement to structural members of the railway car which can withstand those forces.

In accordance with the invention, there is provided a method for installing an elongated cylindrical container having a large capacity for liquids in a refrigerator railway car having an insulated zone comprising the steps of (a) providing framework means affixed to said cylindrical container for supporting said container on its side, said framework means including two elongated, spaced-apart girders, adapted to act as skid members to support said container during movement;
(b) removing one end of said railway car;
(c) inserting the container and affixed framework means into the refrigerator railway car through the resulting open end and into the insulated zone;
(d) securing the cylindrical container in place within the railway car; and
(e) replacing the end of the railway car, thereby enclosing the container within an insulated zone.

There has also been provided means for securing in place the liquid container and the framework means. The framework means comprises two elongated, spaced-apart parallel girders to be supported by the floor of the railway car near the sides thereof; saddle means extending between and joining the parallel girders; circumferential band means extending over said container and urging said container against said saddle means; and, at least one cross-beam extending between said girders intermediate the ends thereof. Vertical beam means are provided which are secured at their upper ends to the cross-beam, extend from the cross-beam downwardly through the floor of the railway car, and are secured at their lower ends to the center sill of the railway car. Means are also provided for transmitting longitudinal forces from the container to the end walls of the railway car.

The resulting combination of container and refrigerator railway car is capable of carrying as much as 600 barrels of liquid and maintaining the liquid at a temperature of about 34° F. or less during transit.

In the combination in accordance with the invention, the diameter of the container is almost as great as the inside width of the railway car having a clearance of no more than about one foot on each side and a clearance of about 3–5 inches on each side being preferred. The length of the container is at least about 75% and preferably about 80% of the total interior length of the railway car, which includes a zone for refrigeration equipment.

In the structure provided, longitudinal forces are absorbed by a combination of the underframe of the railway car and either an end wall or a bulkhead wall, depending on which longitudinal direction the forces are exerted, thus taking advantage of the force-absorbing capabilities of both the railway car body and the cushioned underframe.

DETAILED DESCRIPTION OF THE INVENTION REFRIGERATOR CAR

Figures 1, 3:
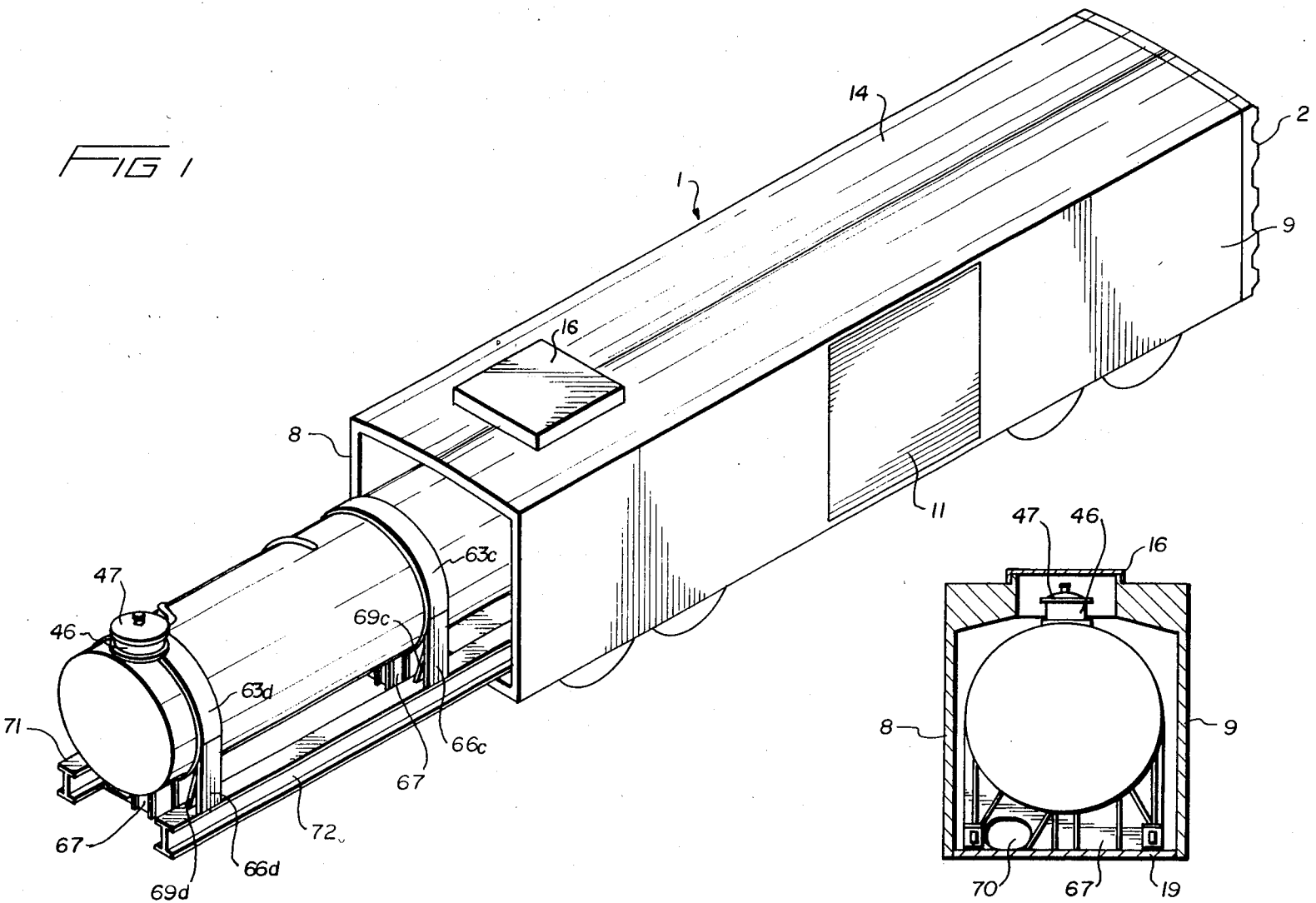
FIG. 1 is a perspective view of a liquid container partially inserted into a refrigerator railway car through one end thereof.
FIG. 3 is a view along section 3—3 of FIG. 2.
Figure 2:
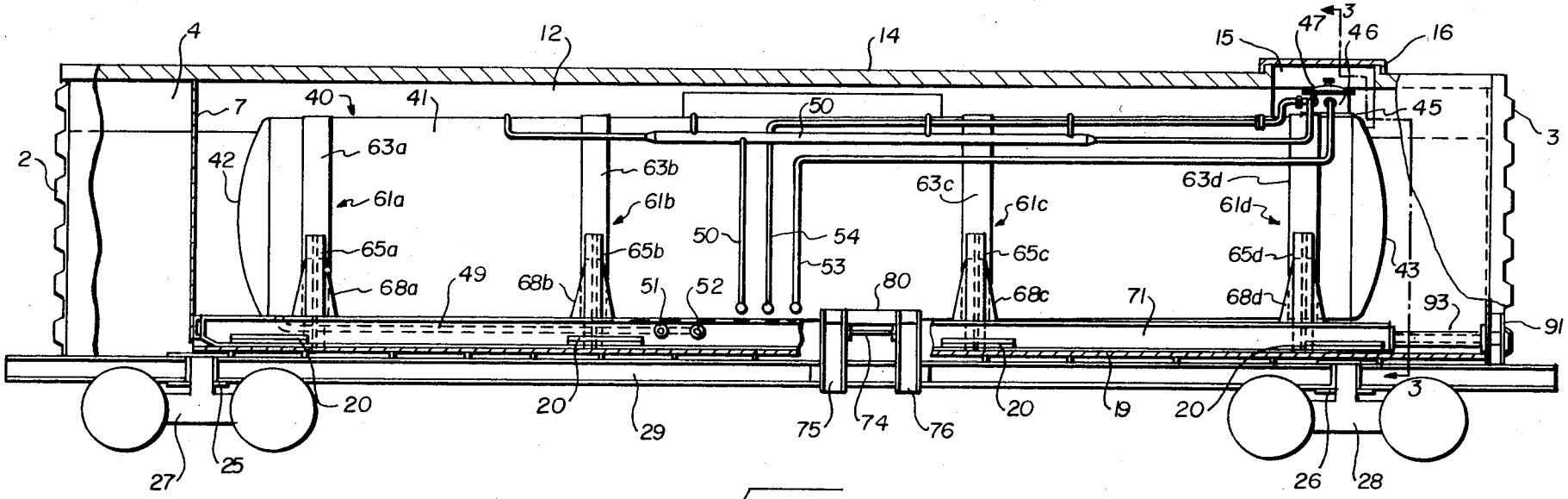
FIG. 2 is a side view of a refrigerator railway car with the liquid container secured in place.
Figure 4:
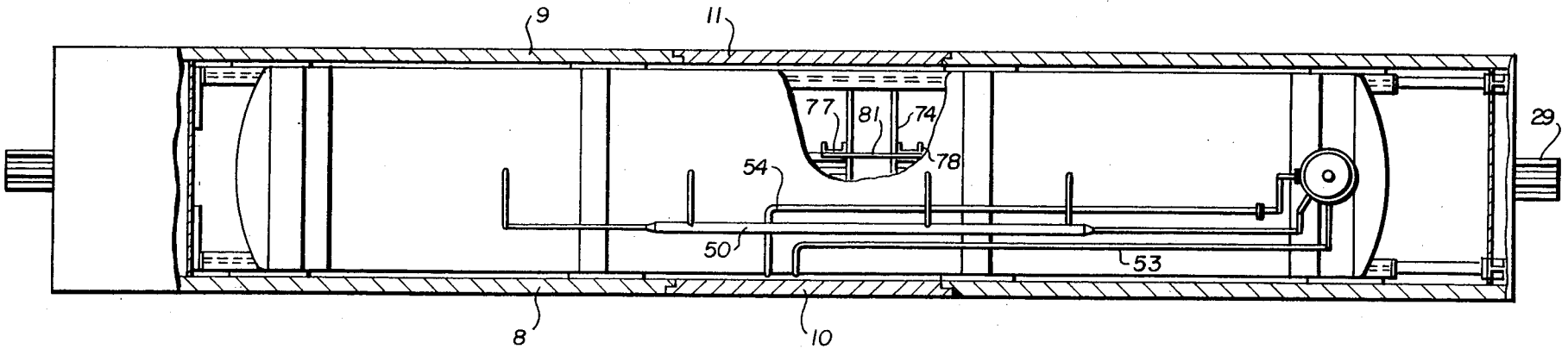
FIG. 4 is a top view of the refrigerator railway car-container combination shown in FIG. 2.

Referring to the refrigerator car as is shown in FIGS. 1, 2 and 4, car body 1 comprises corrugated steel end walls 2, 3, side walls 8, 9, roof 14, floor 19 and side doors 10, 11. Door 10 provides access to controls, inlet and outlet lines, and monitoring means for the liquid container. Car body 1 is supported by an underframe including center sill 29 which is supported at its ends on bolsters 25, 26 which, in turn, are supported on trucks 27, 28. Wall 7 separates insulated zone 12 from refrigeration zone 4, which contains mechanical refrigeration equipment (not shown). This equipment may be of the type conventionally used in refrigerator railway cars including, for example, an engine to drive the refrigerator compressor, a condenser, and a blower to move cooled air through ductwork (not shown) to keep the insulation zone 12 within the railway car at a desired low temperature.

Hatchway 15 provided with hatch cover 16 is provided at the centerline of roof 14 near end wall 3 to provide access to the interior of container 40 through container dome 46.

CONTAINER

Container 40 comprises a cylindrical container shell 41 having heads 42, 43. The container 40 is placed in the railway car so that its axis is substantially directly above the centerline of the railway car, bracing 20 being provided at the floor 19 of the railway car to prevent the container 40 from shifting sideways. The container 40 is positioned longitudinally within the railway car so that its end 42 is near, e.g., approximately one foot from the wall 7, in order to divide the load on the trucks 27, 28 as evenly as possible, but also to provide space to work on refrigeration equipment.

Dome 46 having dome cover 47 is provided near one end of container 40 for physical access to the interior of the container and for monitoring purposes. A clean-in-place (CIP) assembly 50 having four fluid outlet nozzles (not shown) within the container and one fluid outlet nozzle in the dome (not shown) is provided to spray cleaning liquid on the interior surfaces of the container. The container is filled and emptied through inlet-outlet lines 49 which lead from the lower part of the container 40 at end 42 to inlet-outlet assemblies 51, 52. The container slopes downwardly from end 43 to end 42 so that all liquid can be drained from the container through the existing door opening.

When carrying liquid, the container is completely filled in order to prevent the liquid from sloshing back and forth, which would tend to generate large longitudinal forces. Liquid level sensing line 53, which may be a simple overflow line, is provided to indicate when the container has been filled to at least the lower part 45 of dome 46. Line 54 is provided to pressure the liquid with gas, such as $CO_2$, if the need arises.

CONTAINER SUPPORT

Container 40 is held in place by band and saddle assemblies 61*a*, 61*b*, 61*c* and 61*d* which are spaced apart along the container 40 and which hold the container in place on horizontal girders or skids 71, 72. Girders 71, 72 extend the length of container 40 and rest on floor 19. Band and saddle assemblies 61*a*, 61*b*, 61*c* and 61*d* comprise metal bands 63*a*, 63*b*, 63*c* and 63*d*, vertical beams 65*a*, 65*b*, 65*c* and 65*d*, and triangular webs 68*a*, 68*b*, 68*c* and 68*d* on one side of the container, corresponding vertical beams and triangular webs on the other side of the container, and ribbed plates interconnecting girders 71, 72. FIG. 1 shows vertical beams 66*c*, 66*d* and triangular webs 69*c* and 69*d* on the side of the container adjacent to wall 9. Each of the saddle assemblies is provided with a port 70 which is large enough to permit access by workers to the refrigeration zone 4 from the end 3 of the railway car.

Girders 71, 72 are interconnected with cross-beam 74 intermediate the ends of the girders. Cross-beam 74 is preferably placed so that it is about halfway between the ends of girders 71, 72; however, the exact longitudinal placement is not critical since its primary function is to transmit longitudinal forces from the container to center sill 29 of the railway car.

The container 40 is supported on its side so that the head end 42 is at a slightly lower elevation than head end 43.

Figure 7:
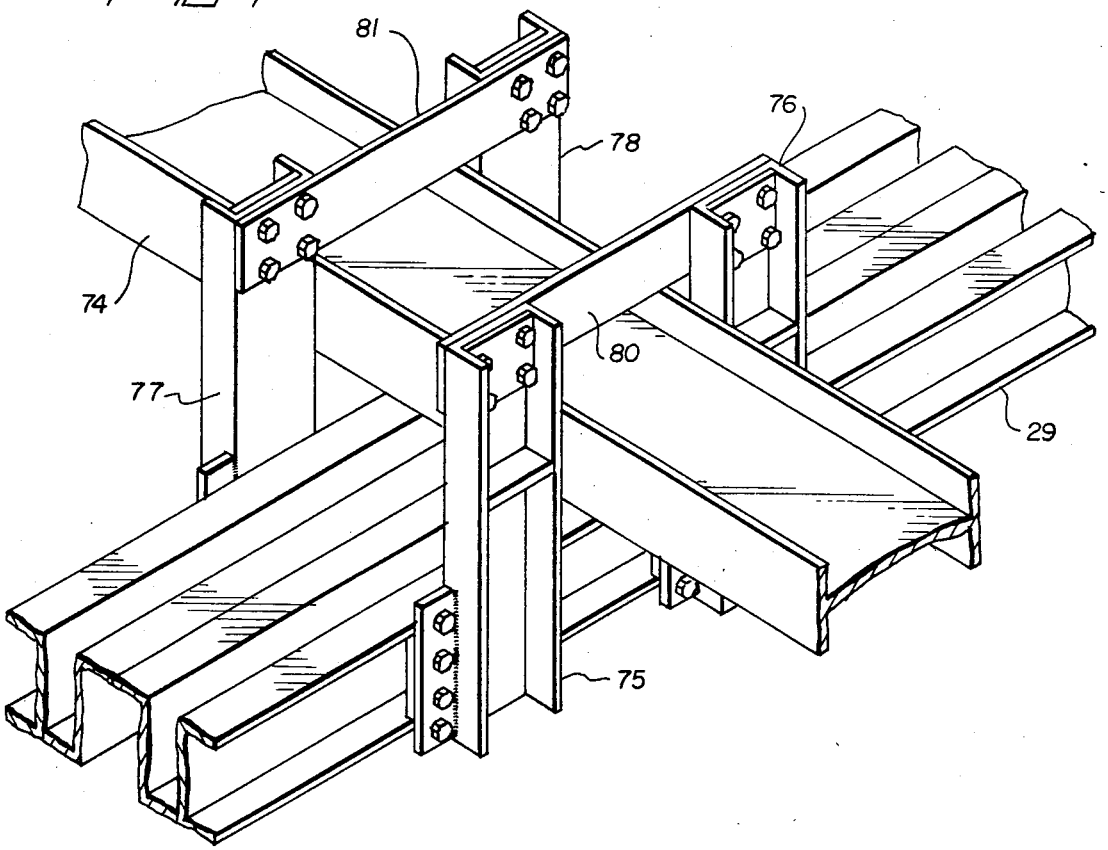
FIG. 7 is a perspective view of means for transmitting longitudinal forces to the center sill of the railway car.

FIG. 7 shows details of means for transmitting longitudinal forces to the center sill 29 of the railway car from the container 40. Vertical channel members 75, 76, 77 and 78 extend from the center sill 29 to which they are attached as by bolting or welding, through the floor 19, to the cross-beam 74. The upper portion of channel members 75, 76, 77, 78 are attached as by welding or bolting to the sides of cross-beam 74, and portions extending above the cross-beam are interconnected by plates 80, 81.

A portion of the longitudinal forces generated by the inertia of the container when the railway car is being accelerated or decelerated is transferred through girders 71, 72 to either bulkhead wall 7 or corrugated end wall 3.

Figure 6:
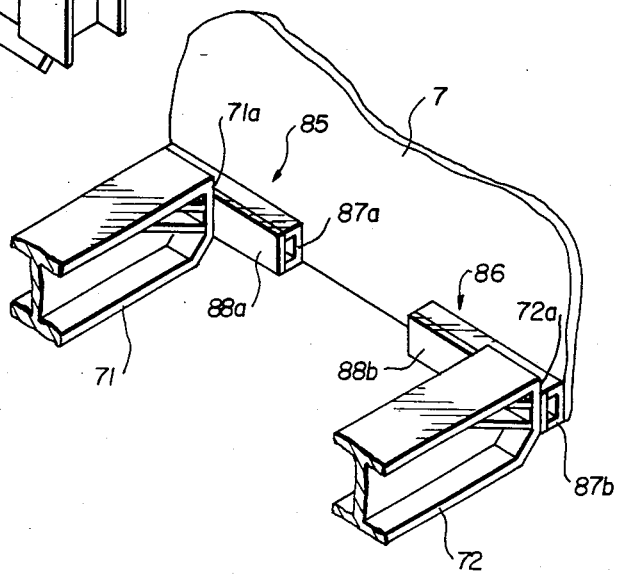
FIG. 6 is a perspective view of means for transmitting longitudinal forces to the bulkhead wall.

FIG. 6 shows structural details of means for transmitting longitudinal forces to the bulkhead wall 7. Force distribution assemblies 85, 86 comprising channel irons 87*a*, 87*b*, and face plates 88*a* and 88*b* are bolted to wall 7 at an elevation and lateral position such that ends 71*a*, 72*a* of girders 71, 72 will make contact with the assemblies 85, 86. Bolting the assemblies 85, 86 to the wall 7 rather than affixing the assemblies to the girder ends assures that the entire surface of the assemblies facing the bulkhead will be in contact with wall 7, thus preventing a high force from being exerted against a small area of wall 7. The ends 71*a*, 72*a* are not affixed to the assemblies 85, 86 and the container assembly is thus able to shift away from wall 7 without damaging it when longitudinal forces are directed away from wall 7.

Figure 5:
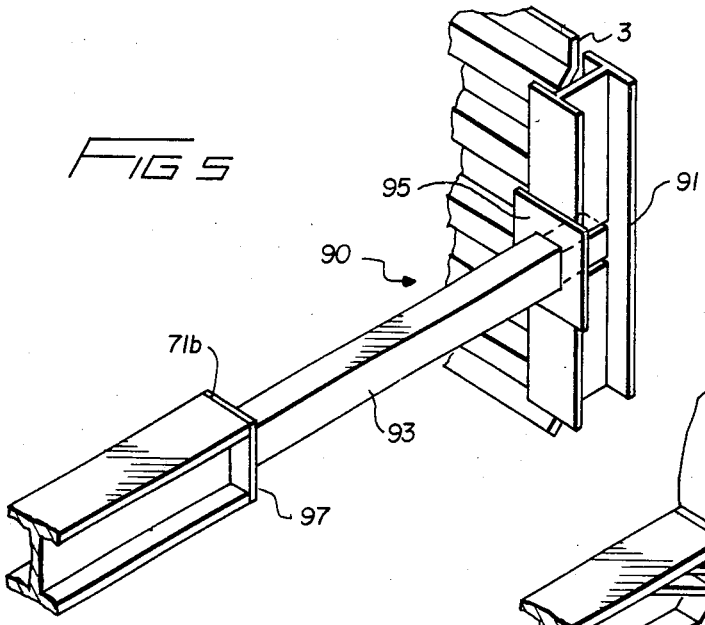
FIG. 5 is a perspective view of a horizontal strut-vertical beam assembly for transmitting horizontal forces to a corrugated end wall of the railway car.

FIG. 5 is a perspective view showing structural details of means for transmitting longitudinal forces to corrugated end wall 3. Force distribution assembly 90 comprises horizontal strut 93 which is fastened to plate 97 at the end 71*b* of girder 71. Plate 95 fastened at the opposite end of strut 93 bears against vertical beam 91. Plate 95 is preferably not tightly secured to vertical beam 91 but is held in place by means such as a stud which extends from the plate 95 through a matching hole provided in the vertical beam 91.

ASSEMBLY OF CONTAINER AND REFRIGERATION CAR

In accordance with one aspect of this invention, the container 40, its supporting structure including girders 71, 72 and elements therebetween, and fixtures for introducing, withdrawing and monitoring the liquid are assembled as a unit. A typical mechanical refrigerator railway car is modified by removing the end wall 3 and providing a hatchway 15 in the roof 14 large enough to accommodate the dome 46. Two rectangular holes are cut in the floor 19 to provide access to each side of the center sill 29 about midway of the railway car so as to be directly under cross-beam 74 when the container 40 is in place in the railway car.

Horizontal force distribution assemblies 85, 86 are bolted in place on wall 7 and the container 40 is skidded into the railway car through the open end on girders 71, 72.

When the container is completely inside the car, the vertical channel members 75, 76, 77 and 78 which interconnect cross-beam 74 with center sill 29 are bolted or welded in place. Bolting has the advantage that the structure is more easily disassembled if the container 40 is to be removed from the railway car.

The end wall 3 is then replaced and force distribution assemblies 90 to transmit longitudinal forces to the end wall 3 are bolted in place at the ends 71*b*, 72*b* of girders 71, 72.

Having thus described the invention, the following example is offered to illustrate it in detail.

EXAMPLE

A stainless steel container having an overall length of 46½ feet, a diameter of 8 feet, 5 inches, and a capacity of 600 barrels was fabricated and assembled on support structures in accordance with FIGS. 2, 3 and 4. The container was mounted to provide a difference in elevation of about 5 inches from the dome end to the end having the inlet-outlet piping. The higher end of the container was provided with a dome about 22 inches in diameter. The container was supported by four saddles attached to two longitudinal girders. The girders were W14 beams 47½ feet long. A W24 beam interconnecting the two girders was centered about 25 feet from the inlet-outlet end of the container.

The refrigerated railway car into which the container was to be placed had a length of about 52 feet between the bulkhead wall and the opposite end of the car, a height from floor to ceiling of about 9 feet 11 inches, and an inside width of about 9 feet 1 inch.

Channel-plate assemblies were bolted in place on wall 7 at an elevation to match the ends 71*a*, 72*a* of girders 71, 72. The channels were 2 feet 5 inches long and weighed 21.4 pounds per foot. The plates were 10 inches wide, 25 inches long and ½ inch thick.

Corrugated end 3 which was opposite the end containing mechanical refrigeration equipment was removed and the container was put in place within the railway car so that the ends 71*a*, 71*b* of the girders 71, 72 were contacting the force distribution assemblies 85, 86 on the bulkhead wall 7.

Cross-beam 74 was interconnected with the center sill 29 as shown in FIG. 7, with four 30.9 pound, 12 inch channels, 2 feet 11 inches long. The portion of the channels extending above cross-beam 74 were interconnected by bolting them together with a ¾ inch steel plate 6 inches wide and about 4 feet long.

Horizontal struts 93, 94, which comprised ¼ inch ×6 inch ×4 inch structural tubing 4 feet 3 inches long, were provided with steel plates at each end. A steel plate ½ inch ×8 inches ×10¾ inches was welded to one end of each strut for bolting onto girder ends 71*b*, 72*b*, and a steel plate ½ inch ×¾ inch ×9½ inches was welded to the other end of each strut for bearing against vertical beams 91, 92. The vertical beams 91, 92 were each a 20 pound H-beam, 2 feet long.

The end wall 3 was replaced and the container 40 was thus completely enclosed within an insulated zone.

What is claimed is:

1. A method for enclosing an elongated cylindrical container having a large capacity for a liquid in a mechanical refrigerator railway car said railway car comprising a floor, a roof, side walls, first and second end walls, a bulkhead intermediate said end walls, an insulated compartment between said bulkhead and said first end wall, a compartment for a refrigeration system between said bulkhead and said second end wall, a center sill having first and second longitudinally-extending sides extending the length of said railway car, and bolsters at each end of said railway car for supporting said center sill and said floor, said method comprising:

(a) providing framework means affixed to said cylindrical container for distributing vertical container forces downwardly through said floor and for distributing longitudinal forces, said framework means comprising two elongated, spaced-apart horizontal girders extending approximately the length of said cylindrical container, and saddle means for supporting said cylindrical container and joining and separating said two girders;

(b) removing said first end of said railway car so as to provide access to the interior of the insulated compartment;

(c) sliding the cylindrical container and affixed framework means into the railway car through the resulting open end;

(d) securing the cylindrical container in place within the railway car by providing a cross-beam which extends between and interconnects the two elongated, spaced-apart horizontal girders and securing to each of said first and second sides of said center sill at least one vertical beam which is adapted to extend upwardly and cooperate with said cross-beam to transfer longitudinal forces from said cross-beam to said center sill; and (e) replacing said first end of said car, thereby enclosing said container within said railway car.

2. The method according to claim 1 wherein said cylindrical container has an axial length of at least about 75% of the interior length of said railway car.

3. The method according to claim 1 wherein said cylindrical container has an axial length of at least about 80% of the interior length of said railway car.

4. The method according to claim 1 wherein the vertical beams are secured to the center sill by welding or by bolting the vertical beams to the center sill.

5. The method according to claim 1 wherein two vertical beams are positioned to extend upwardly from each of said first and second sides of said center sill to a point above said cross-beam, and portions of the vertical beams extending above the cross-beams and on the same side of the center sill are interconnected with a horizontal plate member.

6. In combination, a mechanical refrigerator railway car, an elongated cylindrical container having a large capacity for liquid, and support structure interconnecting said container and said railway car, said railway car having a floor, a roof, side walls, first and second end walls, a bulkhead intermediate said first and second end walls, an insulated compartment between said bulkhead and said first end wall, a compartment for a refrigeration system between said bulkhead and said second end wall, a center sill and bolsters for supporting said center sill and said floor; said elongated cylindrical container being positioned within said railway car between said first end and said bulkhead; said support structure for supporting and retaining said cylindrical container within said railway car comprising:

(a) support means for supporting said cylindrical container with its axis substantially horizontal, comprising two elongated spaced-apart horizontal girders extending longitudinally of the railway car and supported by the floor of said car near each side wall thereof, saddle means extending between said girders and circumferential band means extending over said container and urging said container against said saddle means;

(b) a cross-beam extending between said girders intermediate the ends thereof and perpendicular thereto;

(c) vertical beam means secured to each side of said center sill of the railway car and extending upwardly past and adjacent to said cross-beam for transferring longitudinal forces from said center beam to said center sill;

(d) means for transmitting longitudinal forces from the cylindrical container to the first end wall of said railway car comprising force distribution means at said first end wall for distributing forces over a portion of said end wall, and strut means extending between said force distribution means and the proximal ends of said girders; and (e) means for transmitting longitudinal forces from the cylindrical container to the bulkhead of said railway car comprising force distribution means at said bulkhead for distributing forces over a substantial portion of said bulkhead from the proximal ends of said girders.

7. The combination according to claim 6 wherein said cylindrical container has an axial length at least about as long as 75% of the distance between said first and second ends.

8. The combination according to claim 6 wherein said cylindrical container has an axial length at least about as long as 80% of the distance between said first and second ends.

9. The combination according to claim 6 wherein said cross-beam is located at a point about midway between the ends of said girders.

10. The combination according to claim 6 wherein two vertical beams are secured to each side of said center sill and extend above said cross-beam and plate means are provided to interconnect the upper ends of the two vertical beams at each side.

11. The combination according to claim 6 wherein the force distributing means at said first end wall comprises a vertical post, and said strut means is movable longitudinally with respect to said vertical post.

12. The combination according to claim 6 wherein the force distributing means at said bulkhead comprises a horizontal beam member secured to said wall, and said proximal ends of said girders are movable longitudinally with respect to said horizontal beam member.

13. The combination according to claim 6 wherein:

(a) the cross-beam is located at about the midpoint between the ends of said girders, two vertical beams are secured to each side of the center sill by welds or bolts, said vertical beams extend above said cross-beam, and a horizontal plate interconnects each vertical beam near its top to the vertical beam positioned on the same side of the center sill;

(b) the force distributing means at said first end wall comprises a stub post extending from the floor to a point intermediate the floor and the top of the end wall, and said strut means is loosely attached to said stub post; and (c) the force distribution means at said bulkhead comprises a horizontal beam member bolted to said bulkhead and said proximal ends of said girders are movable longitudinally with respect to said horizontal member.

* * * * *